US009291015B2

(12) United States Patent
Coley et al.

(10) Patent No.: US 9,291,015 B2
(45) Date of Patent: Mar. 22, 2016

(54) SYSTEMS AND METHODS FOR DETERMINING ENHANCED EQUIVALENT CIRCULATING DENSITY AND INTERVAL SOLIDS CONCENTRATION IN A WELL SYSTEM USING MULTIPLE SENSORS

(71) Applicants: Christopher Jeremy Coley, Oxford (GB); Stephen Edwards, Oxford (GB)

(72) Inventors: Christopher Jeremy Coley, Oxford (GB); Stephen Edwards, Oxford (GB)

(73) Assignees: BP Corporation North America Inc., Houston, TX (US); BP Exploration Operating Company Limited (GB)

( * ) Notice: Subject to any disclaimer, the term of this patent is extended or adjusted under 35 U.S.C. 154(b) by 407 days.

(21) Appl. No.: 13/804,864

(22) Filed: Mar. 14, 2013

(65) Prior Publication Data

US 2014/0131101 A1 May 15, 2014

Related U.S. Application Data

(60) Provisional application No. 61/726,673, filed on Nov. 15, 2012.

(51) Int. Cl.

| | |
|---|---|
| ***E21B 21/08*** | (2006.01) |
| ***E21B 47/06*** | (2012.01) |
| ***E21B 47/08*** | (2012.01) |

(52) U.S. Cl.

CPC ..... *E21B 21/08* (2013.01); *E21B 47/06* (2013.01); *E21B 47/08* (2013.01)

(58) Field of Classification Search

CPC ..... E21B 47/06; E21B 21/08

See application file for complete search history.

(56) References Cited

U.S. PATENT DOCUMENTS

| | | | | |
|---|---|---|---|---|
| 2003/0102163 | A1 | 6/2003 | Hemphill | |
| 2004/0221997 | A1 * | 11/2004 | Giroux et al. | 166/380 |
| 2005/0194184 | A1 | 9/2005 | Gleitman | |
| 2014/0012506 | A1 * | 1/2014 | Adsit | 702/6 |

FOREIGN PATENT DOCUMENTS

| | | | |
|---|---|---|---|
| GB | 2354783 | A | 4/2001 |
| GB | 2494051 | A | 2/2013 |
| WO | WO 03/006778 | A1 | 1/2003 |
| WO | WO 2009/144585 | A2 | 12/2009 |
| WO | WO 2011/119668 | A1 | 9/2011 |

OTHER PUBLICATIONS

Coley, C. et al. "The Use of Along String Annular Pressure Measurements to Monitor Solids Transport and Hole Cleaning," SPE/IADC Drilling Conference and Exhibition, No. SPE/IADC 163567, Mar. 5, 2013, pp. 1-35, XP007922456.

* cited by examiner

*Primary Examiner* — Brad Harcourt
(74) *Attorney, Agent, or Firm* — John Poliak

(57) ABSTRACT

Multiple sensors on a drill string can be utilized to perform equivalent circulation density (ECD) analysis. By utilizing multiple ones of the sensors, the pressure drop in each section of the wellbore can be classified. Additionally, the inclusion of multiple sensors in the drill string allows a wellbore to be sectioned into intervals bounded by any two sensors. Pressure events occurring in a single section of the wellbore bounded by any two sensors can be isolated and analyzed. The isolation can be achieved by subtracting the pressure measured on the shallower sensor from that measured on the deeper sensor.

6 Claims, 13 Drawing Sheets

SYSTEMS AND METHODS FOR DETERMINING ENHANCED EQUIVALENT CIRCULATING DENSITY AND INTERVAL SOLIDS CONCENTRATION IN A WELL SYSTEM USING MULTIPLE SENSORS

CROSS-REFERENCE TO RELATED APPLICATIONS

This application claims priority to U.S. Provisional Application No. 61/726,673 filed Nov. 15, 2012, the disclosure of which is incorporated by reference herein in its entirety. This application is related to U.S. patent application Ser. No. 13/804,749, filed Mar. 14, 2013, entitled "SYSTEMS AND METHODS FOR PERFORMING HIGH DENSITY SWEEP ANALYSIS USING MULTIPLE SENSORS" to Christopher Coley and Stephen Edwards, the disclosure of which is incorporated by reference herein in its entirety.

TECHNICAL FIELD

This disclosure relates generally to methods and systems for hydrocarbon exploration and production.

BACKGROUND

In hydrocarbon exploration and production, successful delivery of hydrocarbon wells is often limited by the inability to accurately describe the in-situ wellbore environment in an appropriate time frame. This generally stems from either a lack of downhole data or an inability to process the data gathered into meaningful information. The fact that measurements are commonly made at only two points in the well (at the surface and in the bottom hole assembly (BHA)) also imposes limitations on the ability to understand what is happening downhole. Due to acquiring measurements at only two points, the properties of a fraction of the wellbore being drilled—in general just the area around the BHA—are obtained, leaving significant gaps in assessing the condition of the wellbore. This can affect the ability to accurately detect and diagnose problems (both cause and location).

This lack of empirical data during drilling means that other techniques must be employed in an attempt to fill in the blanks. This usually involves the use of either first principle, statistical or hybrid models. While these models can be useful in certain situations, it is desirable to actually "see" what is happening throughout the wellbore, irrespective of the quality of supporting models (or their setup). Accordingly, there is a need for methods and systems of determining borehole conditions using distributed measurement data along the drill string.

SUMMARY

According to implementations, multiple sensors on a drill string can be utilized to address these drawbacks in equivalent circulation density (ECD) analysis. By utilizing multiple ones of the sensors, the pressure drop in each section of the wellbore can be classified accurately. Additionally, according to implementations, the inclusion of multiple sensors in the drill string allows a wellbore to be sectioned into intervals bounded by any two sensors. In an open system, pressure can be an amalgamation of anything happening above the point of measurement. By utilizing this fact, it can be possible to isolate the pressure events occurring in a single section of the wellbore bounded by any two sensors. The isolation can be achieved by subtracting the pressure measured on the shallower sensor from that measured on the deeper sensor. The subtraction leaves only the pressure caused by "events" in the interval between the two sensors. Part of the pressure events can be the hydrostatic component which can be factor out. The remainder can be made up of anything else that impacts the pressure measured by the sensor in the interval, including transported solids and frictional effects.

For instance, implementations are directed to methods for determining conditions in a hydrocarbon well. The methods include positioning a plurality of sensors in a wellbore. The wellbore includes a drill string. The methods also include determining a depth of each of the plurality of sensors. Further, the methods include determining, while the drill string is static, a static pressure measurement for each of the plurality of sensors. Additionally, the methods include causing the drilling string to operate under at least one test drilling fluid flow rate and at least one test rotation rate. Also, the methods include determining, while the drill string operates under the at least one test drilling fluid flow rate and the at least one test rotation rate, a pressure measurement for each of the plurality of sensors. The methods also include performing an equivalent circulating density analysis based on the depth of each of the plurality of sensors, the static pressure measurement for each of the plurality of sensors, and the pressure measurement for each of the plurality of sensors.

Implementations are also directed to systems for determining conditions in a hydrocarbon well. The systems include a plurality of sensors positioned in a wellbore. The wellbore includes a drill string. The systems also include a computer system configured to perform methods. The methods include determining a depth of each of the plurality of sensors. Further, the methods include determining, while the drill string is static, a static pressure measurement for each of the plurality of sensors. Additionally, the methods include causing the drilling string to operate under at least one test drilling fluid flow rate and at least one test rotation rate. Also, the methods include determining, while the drill string operates under the at least one test drilling fluid flow rate and the at least one test rotation rate, a pressure measurement for each of the plurality of sensors. The methods also include performing an equivalent circulating density analysis based on the depth of each of the plurality of sensors, the static pressure measurement for each of the plurality of sensors, and the pressure measurement for each of the plurality of sensors.

Implementations are also directed to computer readable storage media. The computer readable storage media include instructions for causing one or more processors to perform methods for determining conditions in a hydrocarbon well. The methods include determining a depth of each of a plurality of sensors positioned in a wellbore. The wellbore includes a drill string. Further, the methods include determining, while the drill string is static, a static pressure measurement is obtained for each of the plurality of sensors. Additionally, the methods include causing the drilling string to operate under at least one test drilling fluid flow rate and at least one test rotation rate. Also, the methods include determining, while the drill string operates under the at least one test drilling fluid flow rate and the at least one test rotation rate, a pressure measurement for each of the plurality of sensors. The methods also include performing an equivalent circulating density analysis based on the depth of each of the plurality of sensors, the static pressure measurement for each of the plurality of sensors, and the pressure measurement for each of the plurality of sensors.

Further, implementations are directed to additional methods for determining conditions in a hydrocarbon well. The methods include positioning a plurality of sensors in a wellbore. The wellbore includes a drill string. The methods also include determining a pressure measurement for each of the plurality of sensors during operation of the drill string. Further, the methods include determining a pressure for an interval between a first sensor of the plurality of sensors and a second sensor of the plurality of sensors based on the pressure measurement determined for the first sensor and the pressure measurement determined for the second sensor. Additionally, the methods include determining a drilling fluid pressure contribution for the interval between the first sensor and the second sensor. The method also includes determining a non-drilling fluid pressure contribution for the interval based on the pressure for the interval and the drilling fluid pressure contribution.

Additionally, implementations are directed to systems for determining conditions in a hydrocarbon well. The systems include a plurality of sensors positioned in a wellbore. The wellbore includes a drill string. The systems also include a computer system configured to perform methods. The methods include determining a pressure for an interval between a first sensor of the plurality of sensors and a second sensor of the plurality of sensors based on the pressure measurement determined for the first sensor and the pressure measurement determined for the second sensor. The methods also include determining a drilling fluid pressure contribution for the interval between the first sensor and the second sensor. The methods also include determining a non-drilling fluid pressure contribution for the interval based on the pressure for the interval and the drilling fluid pressure contribution.

Implementations are also directed to computer readable storage media. The computer readable storage media include instructions for causing one or more processors to perform methods for determining conditions in a hydrocarbon well. The methods include determining a pressure for an interval between a first sensor of a plurality of sensors positioned in a wellbore and a second sensor of the plurality of sensors based on the pressure measurement determined for the first sensor and the pressure measurement determined for the second sensor. The wellbore includes a drill string. The methods also include determining a drilling fluid pressure contribution for the interval between the first sensor and the second sensor. Further, the methods include determining a non-drilling fluid pressure contribution for the interval based on the pressure for the interval and the drilling fluid pressure contribution.

BRIEF DESCRIPTION OF THE DRAWINGS

Various features of the implementations can be more fully appreciated, as the same become better understood with reference to the following detailed description of the implementations when considered in connection with the accompanying figures, in which.

DETAILED DESCRIPTION

For simplicity and illustrative purposes, the principles of the present teachings are described by referring mainly to examples of various implementations thereof. However, one of ordinary skill in the art would readily recognize that the same principles are equally applicable to, and can be implemented in, all types of information and systems, and that any such variations do not depart from the true spirit and scope of the present teachings. Moreover, in the following detailed description, references are made to the accompanying figures, which illustrate specific examples of various implementations. Electrical, mechanical, logical and structural changes can be made to the examples of the various implementations without departing from the spirit and scope of the present teachings. The following detailed description is, therefore, not to be taken in a limiting sense and the scope of the present teachings is defined by the appended claims and their equivalents.

Figure 1A:
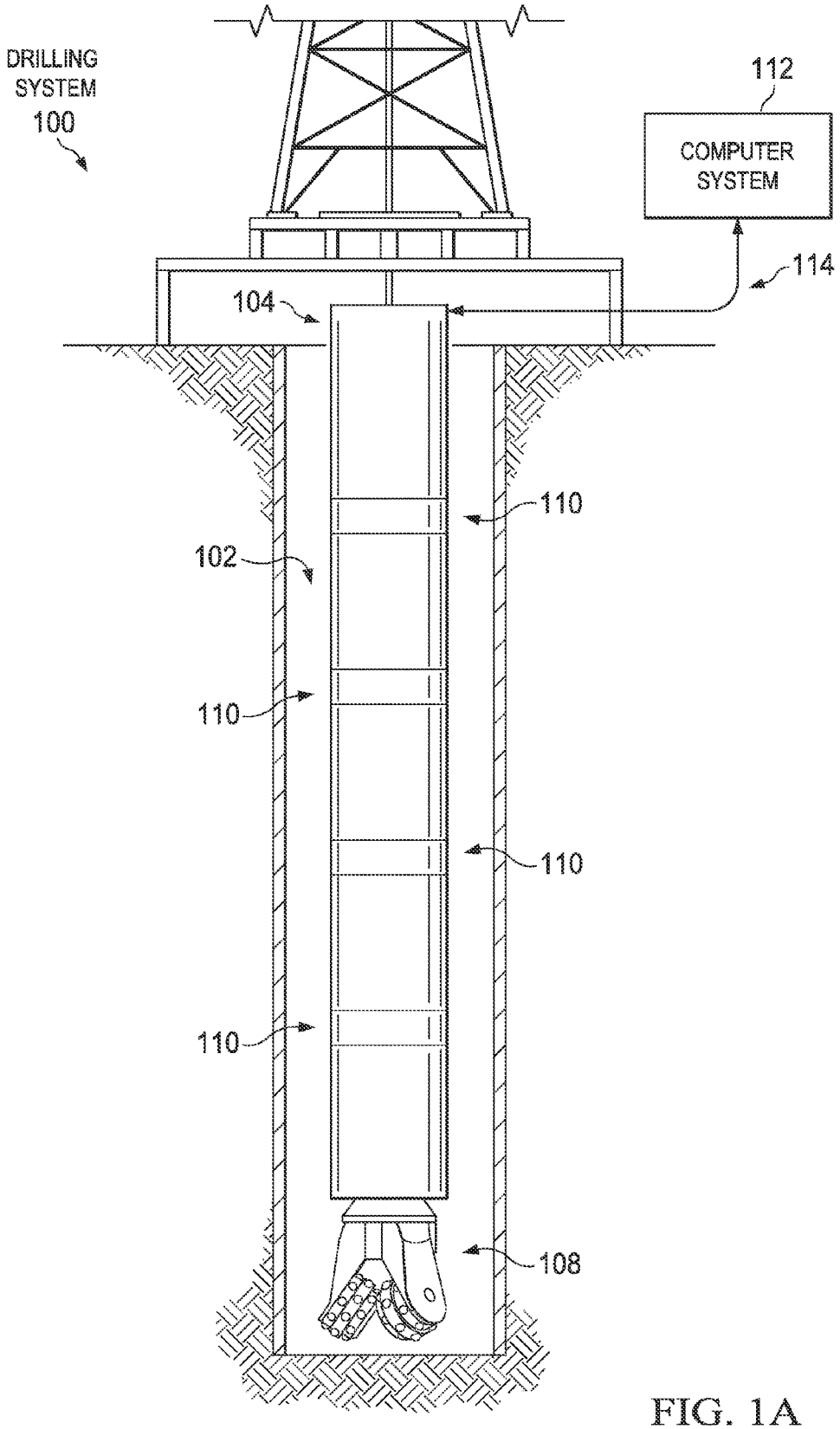
FIG. 1A is a generic diagram that illustrates an example of a drilling system, according to various implementations.

FIG. 1A illustrates a drilling system 100 for drilling boreholes or wellbores for use in hydrocarbon production, according to various implementations. While FIG. 1A illustrates various components contained in the drilling system 100, FIG. 1A is one example of a drilling system and additional components can be added and existing components can be removed.

As illustrated, a wellbore 102 can be created utilizing a drill string 104 having a drilling assembly conveyed downhole by a tubing. The drill string 104 can be used in vertical wellbores or non-vertical (e.g. horizontal, angled, etc.) wellbores. The drilling string 104 can include a bottom hole assembly (BHA) 108, which can include a drill bit. The BHA 108 can include commonly-used drilling sensors such as those described below.

In implementations, the drill string 104 can also include a variety of sensors 110 along its length for determining various downhole conditions in the wellbore 102. Such properties include without limitation, drill string pressure, annulus pressure, drill string temperature, annulus temperature, etc. However, as will be described in more detail below for certain implementations, more specialized sensors may be employed for sensing specific properties of downhole fluids. Such sensors can detect for example without limitation, radiation, fluorescence, gas content, or combinations thereof. As such, the sensors 110 may include without limitation, pressure sensors, temperature sensors, gas detectors, spectrometers, fluorescence detectors, radiation detectors, rheometers, or combinations thereof. Likewise, in implementations, the sensors 110 can also include sensors for measuring drilling fluid properties such as without limitation viscosity, flow rate, fluid compressibility, pH, fluid density, solid content, fluid clarity, and temperature of the drilling fluid at two or more downhole locations. Any of the sensors 110 can also be disposed in the BHA 108.

Data from the sensors 110 can be processed downhole and/or at the surface at a computer system 112. As illustrated, the computer system 112 can be coupled to the sensors by a wire 114. Likewise, the computer system 112 and the sensors 110 can be configured to communicate using wireless signals and protocols. Corrective actions can be taken based upon assessment of the downhole measurements, which may require altering the drilling fluid composition, altering the drilling fluid pump rate or shutting down the operation to clean the wellbore. The drilling system 100 contains one or more models, which may be stored in memory downhole or at the surface. These models are utilized by a downhole computer system and/or the computer system 112 to determine desired drilling parameters for continued drilling. The drilling system 100 can be dynamic, in that the downhole sensor data can be utilized to update models and algorithms in real time during drilling of the wellbore and the updated models can then be utilized for continued drilling operations. Likewise, the computer system 112 can utilize measurements from the sensors 110 to determine conditions in the wellbore 102.

In implementations, the sensors 110 can be placed on the drill string 104 and within the wellbore 102, itself, depending on the type of conditions monitored, the type of data collected, and the processes used to analysis the data. In implementations, the sensors 110 can be positioned so that the sensors 110 are concentrated in the open hole. The open hole consists of the area of the wellbore 102 that does not include a casing. In implementations, the sensors 110 can be positioned so that the sensors 110 are biased towards the open hole with some coverage within the casing. In implementations, the sensors 110 can be positioned so that the sensors 110 are evenly distributed within the wellbore 102.

Figure 1B:
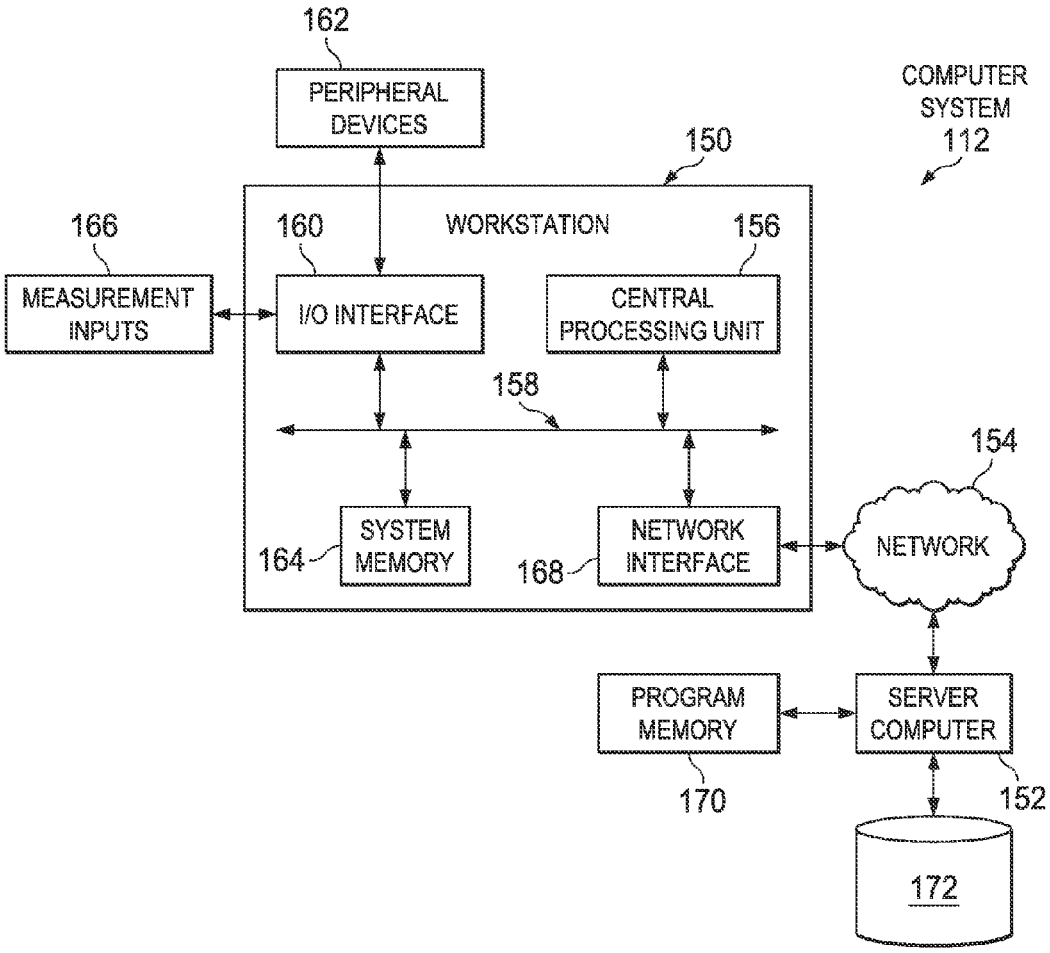
FIG. 1B is a generic block diagram that illustrates an example of a computer system that can be utilized to perform processes described herein, according to various implementations.

FIG. 1B illustrates an example of the computer system 112, which can perform processes to analyze and process distributed measurement data, according to various implementations. As illustrated, the computer system 112 can include a workstation 150 connected to a server computer 152 by way of a network 154. While FIG. 1B illustrates one example of the computer system 112, the particular architecture and construction of the computer system 112 can vary widely. For example, the computer system 112 can be realized by a single physical computer, such as a conventional workstation or personal computer, or by a computer system implemented in a distributed manner over multiple physical computers. Accordingly, the generalized architecture illustrated in FIG. 1B is provided merely by way of example.

As shown in FIG. 1B, the workstation 150 can include a central processing unit (CPU) 156, coupled to a system bus (BUS) 158. An input/output (I/O) interface 160 can be coupled to the BUS 158, which refers to those interface resources by way of which peripheral devices 162 (e.g., keyboard, mouse, display, etc.) interface with the other constituents of the workstation 150. The CPU 156 can refer to the data processing capability of the workstation 150, and as such can be implemented by one or more CPU cores, co-processing circuitry, and the like. The particular construction and capability of the CPU 156 can be selected according to the application needs of the workstation 150, such needs including, at a minimum, the carrying out of the processes described below, and also including such other functions as can be executed by the computer system 112. A system memory 164 can be coupled to system bus BUS 158, and can provide memory resources of the desired type useful as data memory for storing input data and the results of processing executed by the CPU 156, as well as program memory for storing computer instructions to be executed by the CPU 156 in carrying out the processes described below. Of course, this memory arrangement is only an example, it being understood that system memory 164 can implement such data memory and program memory in separate physical memory resources, or distributed in whole or in part outside of the workstation 150. Measurement inputs 166 that can be acquired from different sources such as the sensors 110 can be input via I/O interface 160, and stored in a memory resource accessible to the workstation 150, either locally, such as the system memory 164, or via a network interface 168.

The network interface 168 can be a conventional interface or adapter by way of which the workstation 150 can access network resources on the network 154. As shown in FIG. 1B, the network resources to which the workstation 150 can access via the network interface 168 includes the server computer 152. The network 154 can be any type of network or combinations of network such as a local area network or a wide-area network (e.g. an intranet, a virtual private network, or the Internet). The network interface 168 can be configured to communicate with the network 154 by any type of network protocol whether wired or wireless (or both).

The server computer 152 can be a computer system, of a conventional architecture similar, in a general sense, to that of the workstation 150, and as such includes one or more central processing units, system buses, and memory resources, network interfaces, and the like. The server computer 152 can be coupled to a program memory 170, which is a computer-readable medium that stores executable computer program instructions, according to which the processes described below can be performed. The computer program instructions can be executed by the server computer 152, for example in the form of a "web-based" application, upon input data communicated from the workstation 150, to create output data and results that are communicated to the workstation 150 for display or output by the peripheral devices 162 in a form useful to the human user of the workstation 150. In addition, a library 172 can also available to the server computer 152 (and the workstation 150 over the network 154), and can store such archival or reference information as may be useful in the computer system 112. The library 172 can reside on another network and can also be accessible to other associated computer systems in the overall network.

Of course, the particular memory resource or location at which the measurements, the library 172, and the program memory 170 physically reside can be implemented in various locations accessible to the computer system 112. For example, these measurement data and computer program instructions for performing the processes described herein can be stored in local memory resources within the workstation 150, within the server computer 152, or in network-accessible memory resources. In addition, the measurement data and the computer program instructions can be distributed among multiple locations. It is contemplated that those skilled in the art will be readily able to implement the storage and retrieval of the applicable measurements, models, and other information useful in connection with implementations, in a suitable manner for each particular application.

In implementations, the computer system 112 can utilize measurements from the sensors 110 in order to determine conditions in the wellbore 102. Described below are several examples of processes that can be performed utilizing the sensors 110 to determine conditions within the wellbore 102 according to various implementations.

Equivalent Circulating Density (ECD) Fingerprinting

ECD fingerprinting is an empirical method that can be used to measure the impact of changes in flow rate of drilling fluid and rotation speed of the drill string on the frictional back pressure in the wellbore. In general, frictional losses may only be significant in smaller diameter hole sizes (e.g., 14" and lower) creating a limit on the applicability of the conventional method. The conventional method may also have some limitations including a maximum section length over which the technique is useful and sensitivity to changes in the drilling fluid system properties (although at least one of these, density, can manually be adjusted for). When applied correctly, ECD fingerprinting provides an alternative to hydraulic modeling techniques and has the advantage that the baseline that it generates is calibrated to the specific sensors and wellbore conditions of the section in which it is performed.

In the conventional methods for ECD fingerprinting, a pressure measurement of annulus press is taken at only one point along a drill string during operation of the drill string. The pressure measurement is then used in combination with a static measurement to work out the additional pressure caused by friction of the fluid flow of the drilling fluid and rotation of the drill string. The pressure contribution due to flow friction and rotation effects is given by the equation:

$$P_{friction+rotation}=P_1-P_{1static}$$

where $P_1$ is the pressure measurement at the one point along the drill string during operation and $P_{1static}$ is the static pressure.

From this, an equivalent pressure drop per unit length can be calculated from the pressure contribution due to frictional and rotational effects. The equivalent pressure drop is give by the equation:

$$P_{drop\ per\ unit\ length}=P_{friction+rotation}\div L_1$$

where $L_1$ is the length of the drill string above the sensor at which the measurement is being made (the measured depth of the sensor).

The drawbacks to the conventional methods, with only one pressure measurement, are that the method assumes that the frictional pressure drop is spread evenly throughout the wellbore. This is typically not the case. Typically, the diameter of the wellbore varies throughout the length of the well. Smaller diameter sections of the wellbore will, in general, have a higher pressure drop so that the $P_{drop\ per\ unit\ length}$ calculated using the above equations underestimates the frictional drop in the smaller diameter sections and overestimates the drop in the larger diameters sections of the wellbore.

Because of this, additional error is introduced into the subsequent calculations. Once $P_{drop\ per\ unit\ length}$ has been calculated, it is used to predict the pressure that would be seen while drilling with a completely clean wellbore (one in which no drilled solids are present). This is done by adding the static density at the current sensor depth to the $P_{drop\ per\ unit\ length}$ multiplied by the measured depth of the sensor. This is given by the equation:

$$P_{predicted}=P_{drop\ per\ unit\ length}\times D_{sensor}+P_{static}$$

where $D_{sensor}$ is the measured depth of the sensor and $P_{static}$ is the static pressure at the $D_{sensor}$ obtained either from hydraulic modeling or by direct measurement.

If the sensor is located in the different diameter area than other sections of the wellbore, error is introduced into this calculation. For example, if located in a smaller diameter section of the wellbore that is increasing in length due to drilling, the calculation gives a value which is less than it should be because the $P_{drop\ per\ unit\ length}$ is under-valued in the smaller diameter section of the wellbore.

Figure 2:
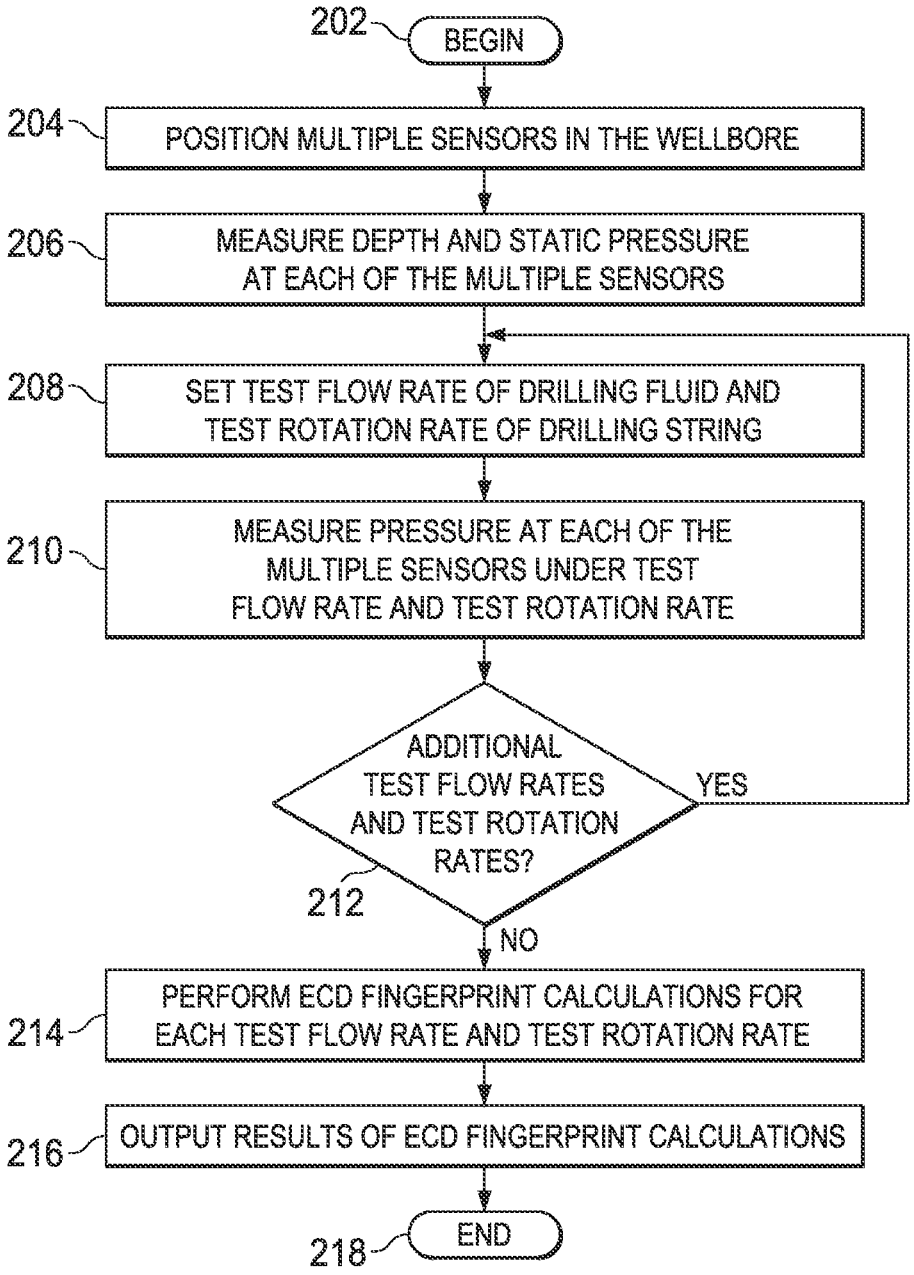
FIG. 2 is flow diagram that illustrates an example of process for ECD fingerprinting, according to various implementations.

According to implementations, the sensors 110 on the drill string 104 can be utilized to address these errors. In particular, by utilizing multiple ones of the sensors 110, the pressure drop in each section of the wellbore can be classified accurately. FIG. 2 illustrates an example of a process for performing ECD fingerprinting using multiple sensors, according to various implementations. While FIG. 2 illustrates various processes that can be performed by the computer system 112, any of the processes and stages of the processes can be performed by any component of the computer system 112 or the drilling system 100. Likewise, the illustrated stages of the processes are examples and any of the illustrated stages can be removed, additional stages can be added, and the order of the illustrated stages can be changed.

Figure 3:
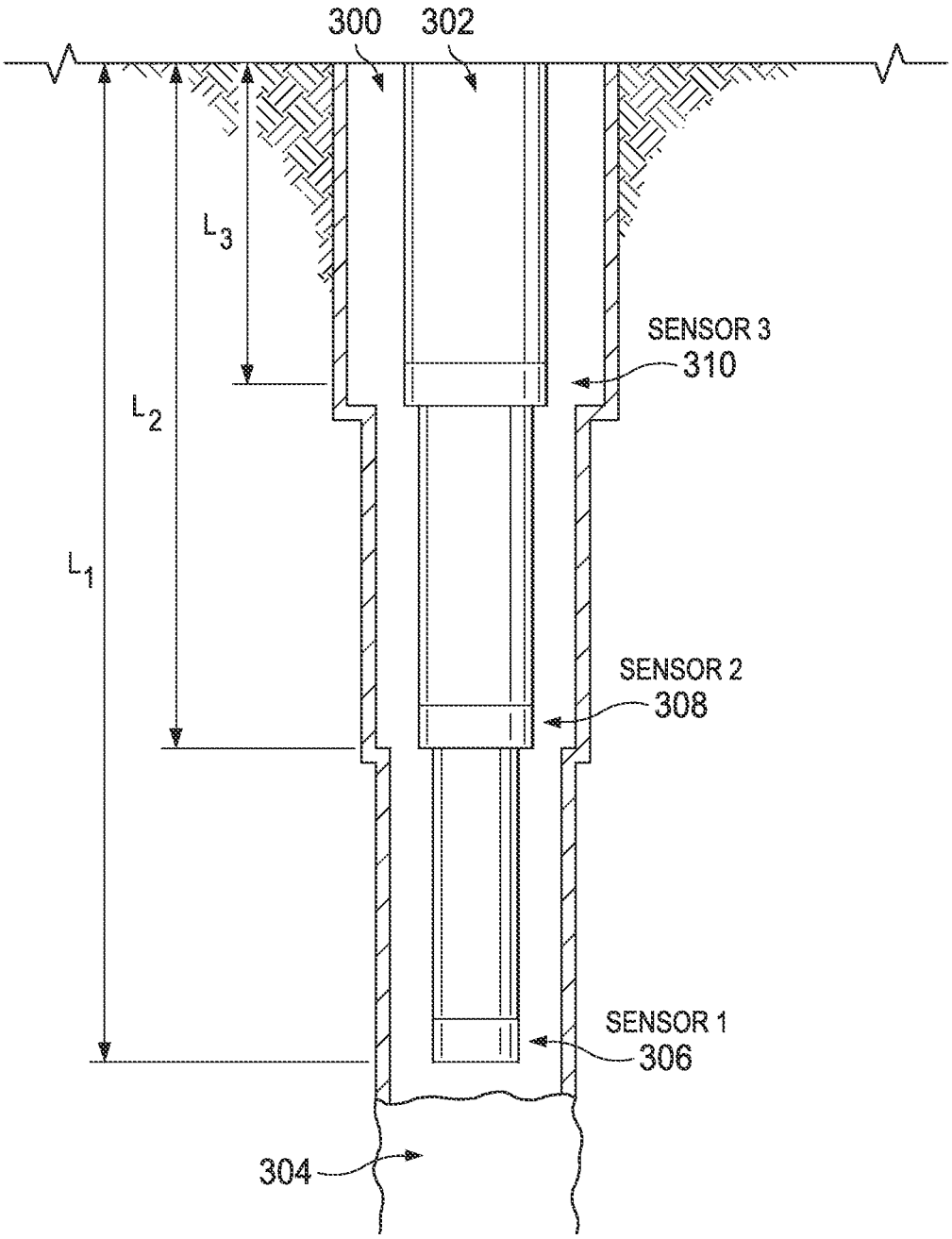
FIG. 3 is a generic diagram that illustrates an example of a wellbore in which ECD fingerprinting can be performed, according to various implementations.

In 202, the process can begin. In 204, sensors can be positioned in the wellbore. For example, the sensor 110 can be positioned within the wellbore 102 in order to account for varying diameters of the wellbore 102. FIG. 3 illustrates an example of a wellbore 300 with varying diameters. As illustrated, a drill string 302 can be utilized to create the wellbore 302 including future portions 304. The drill string 302 can include multiple sensors for measuring conditions within the wellbore 300 such as sensor 1 306, sensor 2 308, and sensor 3 310. As illustrated, the sensor 1 306, sensor 2 308, and sensor 3 310 can be positioned so that the sensors corresponds with a change in the diameter of the wellbore 300. While FIG. 3 illustrates three sensors, any number of sensors can be used to correspond to changes in the diameter of the wellbore 300. Likewise, while FIG. 3 illustrates the sensors being placed on the drill string 302, one or more of the sensors can be placed in other locations such as the wall of the wellbore, in a casing of the wellbore, and the like.

In 206, the computer system 112 can measure depth and static pressure at each of the multiple sensors. As illustrated in FIG. 3, the sensor 1 306 can be located a depth $L_1$, the sensor 2 308 can be located at a depth $L_2$, and the sensor 3 310 can be located at a depth $L_3$, and the computer system 112 can determine the depth of the sensor 1 306, the sensor 2 308, and the sensor 3 310. The computer system 112 can acquire the depth of sensors using any type of technique. For example, the computer system 112 can determine the depth based on known lengths of the sections of the drill string 302 and position of the sensors on the drill string 302. Drilling can be suspended in the wellbore, and the computer system 112 can acquire a pressure measurement from the sensor 1 306, the sensor 2 308, and the sensor 3 310.

In 208, a test flow rate of drilling fluid and test rotation rate of drilling string can be set within the wellbore. The test flow rate of drilling fluid and test rotation rate can be set by the computer system 112 or other control system in the drilling system 100. Table 1 illustrates examples of the test flow rate of drilling fluid and test rotation rate.

TABLE 1

| Rotation rate (RPM) | Flow rate (gpm) |
|---|---|
| 60 | 900 |
| 60 | 1050 |
| 60 | 1200 |
| 90 | 900 |
| 90 | 1050 |
| 90 | 1200 |
| 120 | 900 |
| 120 | 1050 |
| 120 | 1200 |

In 210, the computer system 112 can measure the pressure at each of the multiple sensors under the test flow rate of drilling fluid and test rotation rate. For example, as illustrated in FIG. 3, the pressure can be measured for each of the sensor 1 306, sensor 2 308, and sensor 3 310. In 212, the computer system 112 can repeat 208 and 210 in order to acquire pressures under different test flow rates of drilling fluid and test rotation rates.

In 214, the computer system 112 can perform ECD fingerprint calculations for each test flow rate and test rotation rate. For example, referring to FIG. 3, the computer system 112 can calculate the pressure drops per unit length for each of the sensor 1 306, sensor 2 308, and sensor 3 310 under each of the test flow rate and test rotation rate. Each sensor measures the increase in frictional pressure caused by flow or rotation in the wellbore above it and from these pressure drops per unit length are calculated. The pressure drops per unit length can be calculated using the following equations:

$$P_{drop\ per\ unit\ length\ 1}=[[P_1-P_{1static}]-[P_2-P_{2static}]]\div[L_1-L_2]$$

where $P_1$ is the pressure measured at sensor 1 under a particular flow and rotation, $P_{1static}$ is the static pressure at measured sensor 1, $P_2$ is the pressure measured at sensor 2 under the particular flow and rotation, $P_{2static}$ is the static pressure measured at sensor 2, $L_1$ is the depth of sensor 1, and $L_2$ is the depth of sensor 2.

$$P_{drop\ per\ unit\ length\ 2}=[[P_2-P_{2static}]-[P_3-P_{3static}]]\div[L_2-L_3]$$

where $P_2$ is the pressure measured at sensor 2 under the particular flow and rotation, $P_{2static}$ is the static pressure at measured sensor 2, $P_3$ is the pressure measured at sensor 3 under the particular flow and rotation, $P_{3static}$ is the static pressure measured at sensor 3, $L_2$ is the depth of sensor 2, and $L_3$ is the depth of sensor 3.

$$P_{drop\ per\ unit\ length\ 3}=[P_3-P_{3static}]\div[L_3]$$

where $P_3$ is the pressure measured at sensor 3 under the particular flow and rotation, $P_{3static}$ is the static pressure measured at sensor 3, and $L_3$ is the depth of sensor 3 (Note in this case sensor 3 is the shallowest sensor in the wellbore and no sensors are present above this point). Where it is possible to measure static pressures a comparison can also be made between the measured static pressure for each sensor and the modeled.

These calculations allow the frictional drop in each section of the annulus for each combination of flow and rotation to be calculated. Additionally, the computer system 112 can calculate the anticipated annular pressure while drilling for each of the sensor 1 306, sensor 2 308, and sensor 3 310. The anticipated annular pressure for sensor 1 306 is given by the equation:

$$P_{1\ Drilling}=P_{1\ Static}+[P_{Drop\ per\ unit\ length\ 1}\times(L_x-L_2)]+[P_{Drop\ per\ unit\ length\ 2}\times(L_2-L_3)]+[P_{Drop\ per\ unit\ length\ 3}\times L_3]$$

where sensor 1 306 is located deeper than $L_2$; $P_{1\ Drilling}$=A calculated value of the clean wellbore pressure expected at sensor 1 306, $P_{1\ Static}$=Static pressure derived either from a model or, where available, direct measurement; $P_{Drop\ per\ unit\ length\ 1}$=The pressure drop per unit length as calculated in the equation described above; $P_{Drop\ per\ unit\ length\ 2}$=The pressure drop per unit length as calculated in the equation described above; $P_{Drop\ per\ unit\ length\ 3}$=The pressure drop per unit length as calculated in the equation described above; $L_x$=The current measured depth of sensor 1 306; $L_2$=The measured depth of sensor 2 308 when the ECD fingerprint operation was undertaken; and $L_3$=The measured depth of sensor 3 310 when the ECD fingerprint operation was undertaken.

The anticipated annular pressure for sensor 2 308 while the sensor depth is greater than L2 is given by the equation:

$$P_{2\ Drilling}=P_{2\ Static}+[P_{Drop\ per\ unit\ length\ 1}\times(L_y-L_2)]+[P_{Drop\ per\ unit\ length\ 2}\times(L_2-L_3)]+[P_{Drop\ per\ unit\ length\ 3}\times L_3]$$

where sensor 2 308 is located deeper than $L_2$; $P_{2\ Drilling}$=A calculated value of the clean wellbore pressure expected at sensor 2 308; $P_{2\ Static}$=Static pressure derived either from a model or, where available, direct measurement; $P_{Drop\ per\ unit\ length\ 1}$=The pressure drop per unit length as calculated in the equation described above; $P_{Drop\ per\ unit\ length\ 2}$=The pressure drop per unit length as calculated in the equation described above; $P_{Drop\ per\ unit\ length\ 3}$=The pressure drop per unit length as calculated in the equation described above; $L_y$=The current measured depth of sensor 2 308; $L_2$=The measured depth of sensor 2 308 when the ECD fingerprint operation was undertaken; and $L_3$=The measured depth of sensor 3 310 when the ECD fingerprint operation was undertaken.

The anticipated annular pressure for sensor 3 310 while the sensor depth is greater than L3 and less than L2 is given by the equation:

$$P_{3\ Drilling}=P_{3\ Static}+[P_{Drop\ per\ unit\ length\ 2}\times(L_z-L_3)]+[P_{Drop\ per\ unit\ length\ 3}\times L_3]$$

where sensor 3 310 is located deeper than $L_3$ and shallower than $L_2$; $P_{3\ Drilling}$=A calculated value of the clean wellbore pressure expected at sensor 3 310; $P_{3\ Static}$=Static pressure derived either from a model or, where available, direct measurement; $P_{Drop\ per\ unit\ length\ 2}$=The pressure drop per unit length as calculated in the equation described above; $P_{Drop\ per\ unit\ length\ 3}$=The pressure drop per unit length as calculated in the equation described above; $L_z$=The current measured depth of sensor 3 310; $L_2$=The measured depth of sensor 2 308 when the ECD fingerprint operation was undertaken; and $L_3$=The measured depth of sensor 3 310 when the ECD fingerprint operation was undertaken.

The anticipated annular pressure for sensor 3 310 while the sensor depth is greater than L2 is given by the equation $$P_{3drilling}=P_{3model}+[p2-p2\text{static}]+[[(P_1-P_{2static})]/(L1-L2)]\times(Lz-L2)$$

where $P_{3model}$ is determined from a hydraulic model prediction of mud density at the depth of sensor 3 310 and where Lz is the measured depth of sensor 3 310.

According to these equations the impact of any constant offset error in the sensors is removed and relies only on the ability of each sensor to accurately detect changes in pressure.

Figure 4:
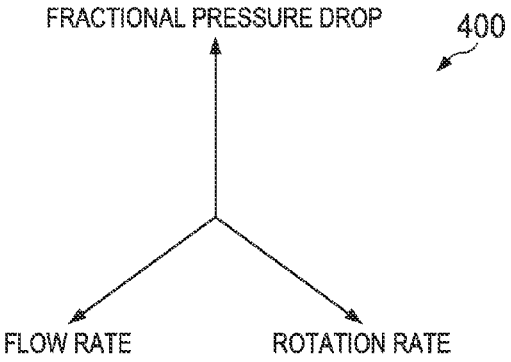
FIG. 4 is a diagram that illustrates an example of a plot of ECD fingerprinting, according to various implementations.

In 216, the computer system 112 can output the results of the ECD fingerprint calculations. For example, the computer system 112 can output the results on the peripheral devices 162. The computer system 112 can output the results in numerical form. Likewise, the computer system 112 can output the results in graphical form. FIG. 4 illustrates an example of a graph 400 that can be used to display the results. As illustrated, the graph 400 can be a 3D surface graph that plots frictional pressure drop versus flow rate versus rotational rate. The points in the graph 400 can be used to calculate the defining equation of a surface for combinations of flow rate and rotational rate. The tested bounds of the corresponding point on the surface can be used to provide the appropriate frictional pressure drops.

In 218, the process can end, repeat, or return to any stage.

Figure 5A:
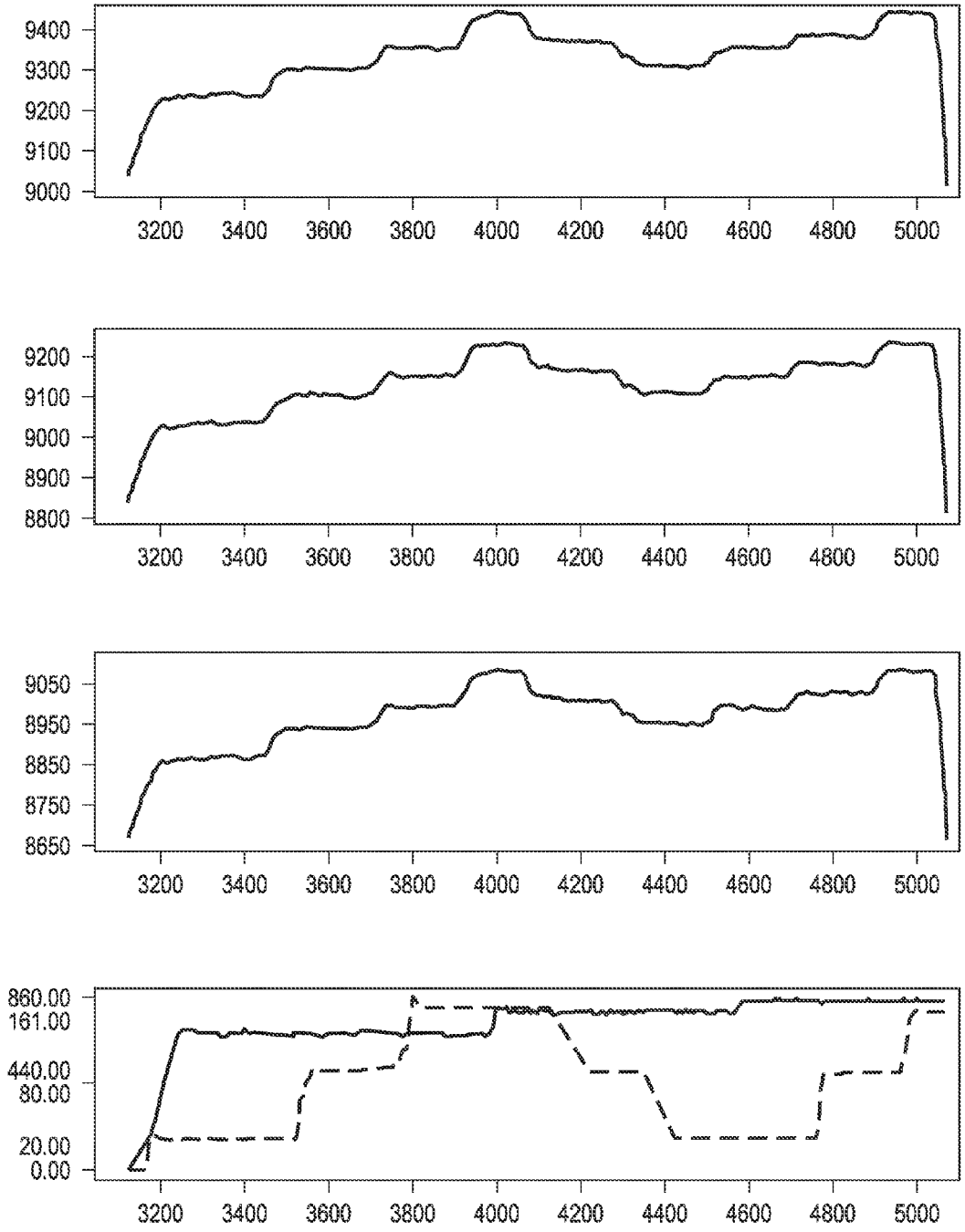
FIGS. 5A-5C are diagrams that illustrate examples of a ECD fingerprinting, according to various implementations.
Figure 5B:
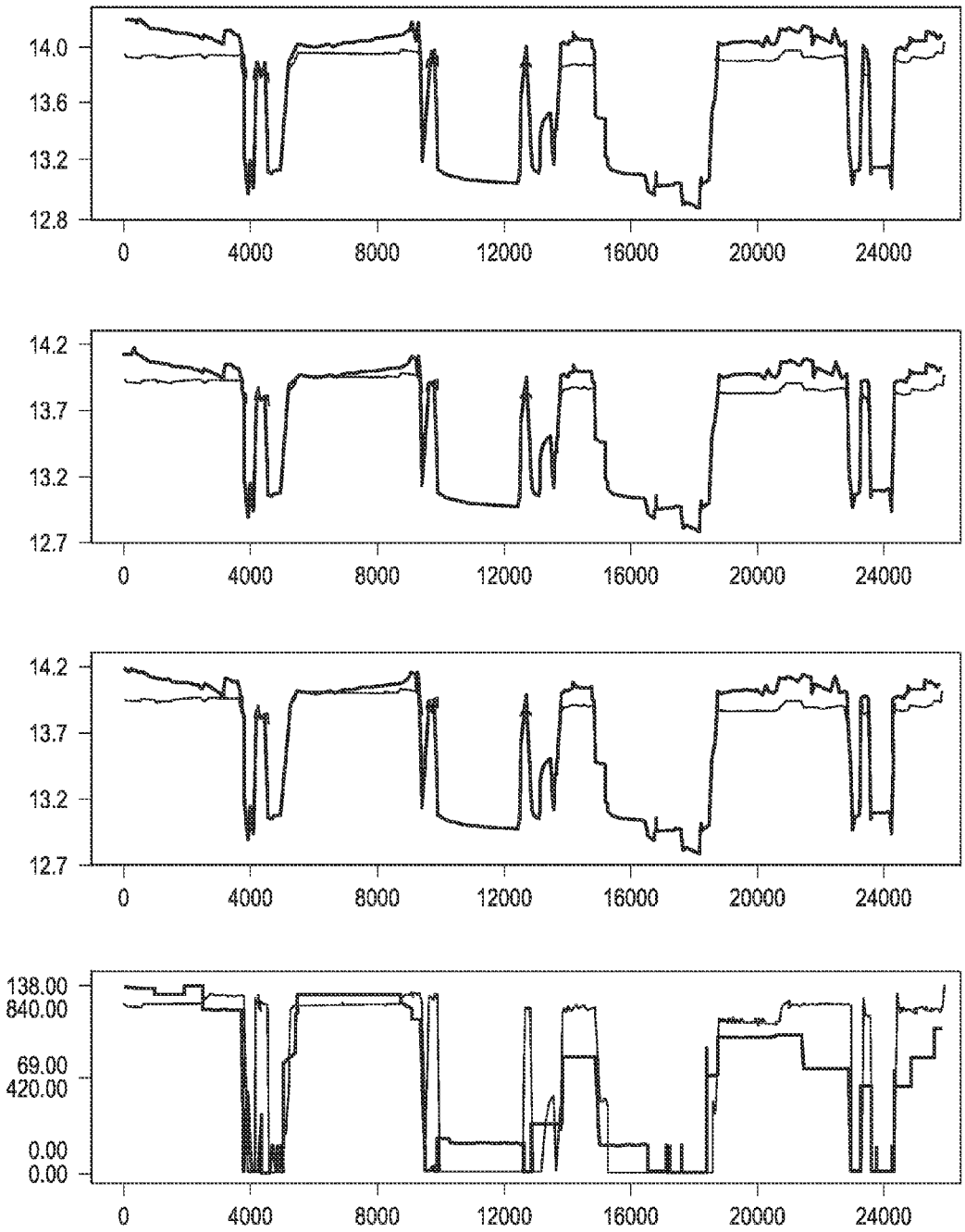
Figure 5C:
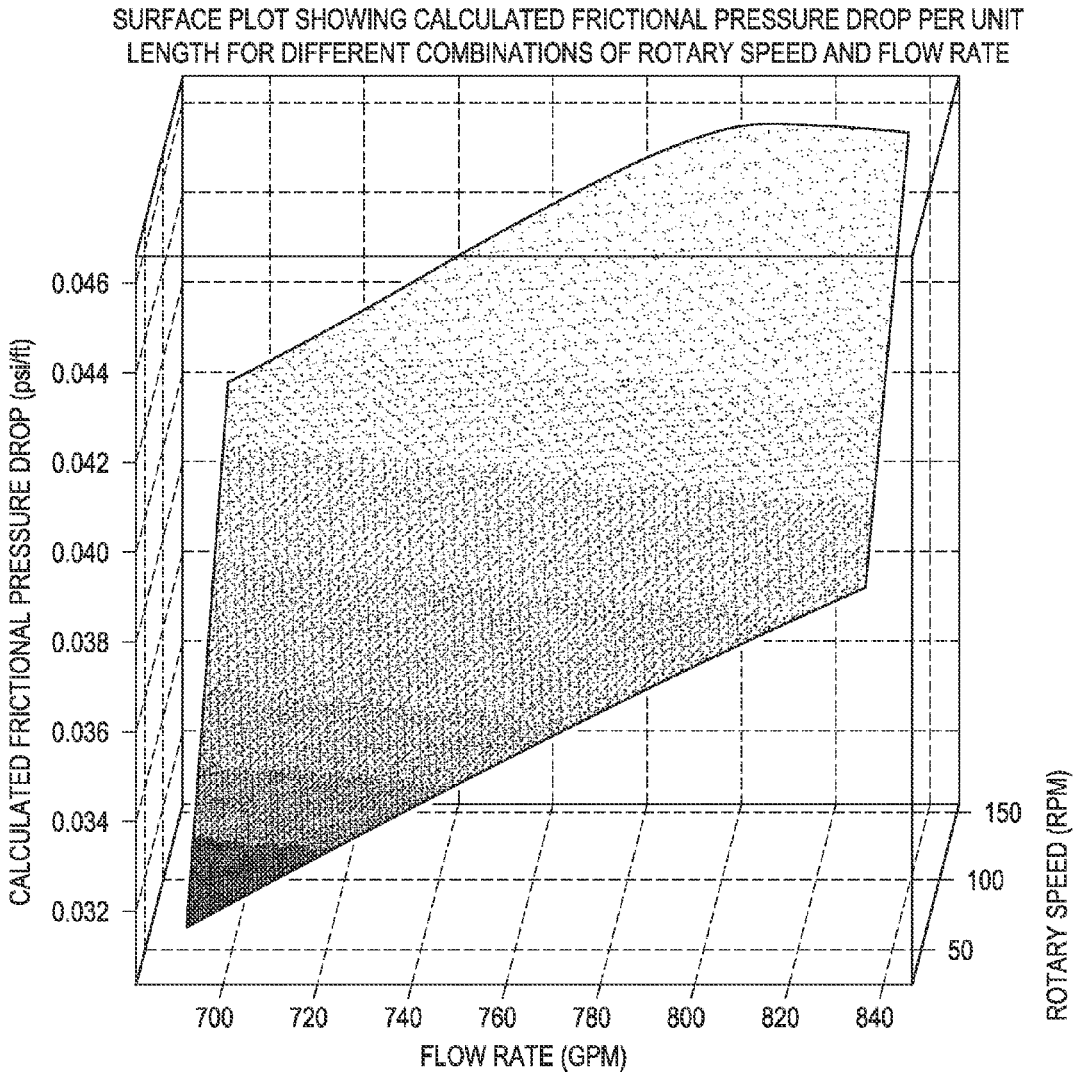

FIGS. 5A, 5B, and 5C illustrate measurements taken from a test wellbore. FIG. 5A shows an example of the measurements taken during a typical ECD fingerprint; note the strong response of the annular pressure to changes in rotational speed of the drill pipe. The fingerprint was carried out in a 9½" hole section on a wellbore. FIG. 5B shows an example of the output results generated by applying the processes described above. It can be seen that the measured ECD, in black, and ECD predictions based on the fingerprinting, in red, match up nicely providing a good indication of what, assuming no solids in the annulus, the pressure and ECD readings should be while drilling. In this particular example, the impacts of solids transport can clearly be seen as the actual pressure and ECD curves deviate away from the calculated values as the stand is drilled ahead. Again this deviation exhibits a curve like quality demonstrating the progression of transported solids along the wellbore and out of the well. FIG. 5C shows an example of the graph 400 for the test wellbore.

The availability of annular pressure measurements along the drill string presents a unique opportunity to remove error from ECD fingerprinting. By positioning a sensor in the drill string so that, during the fingerprinting, it is located just above the final change in internal casing diameter a measurement can be made of the total static frictional pressure loss of the entire wellbore above the last annulus. Because all but the final annulus will remain unchanged in length during the drilling of the next section, this amalgamated frictional drop can simply be added to any value calculated for the final annulus and subsequent open hole as drilling continues. Because individual measurements of static density are taken prior to commencing the fingerprinting, the fact that there may be a constant offset error on a given measurement section does not matter. All that is desired is the relative changes in pressure during the flow and rotation tests. The application of this method to the fingerprinting process will help to mitigate the impact of errors caused by variation in frictional pressure losses in differing diameter annular sizes.

High Density Sweep Analysis

High density sweeps are commonly used to enhance solids suspension and transport during well construction operations. This is especially true in environments where the ability to transport solids around the wellbore is known to be less than ideal (for example in large diameter intermediate or high inclination wellbores). High density sweeps work by increasing the buoyancy force exerted on solids in the wellbore in the vicinity of the sweep (if the viscosity of the sweep is increased this can also have an impact although the use of viscosified sweeps in anything other than near vertical wellbores is not recommended due to flow diversion to the high side of the well). This increase in buoyancy makes the solids easier to re-suspend and, once re-suspended, easier to transport. The effectiveness of these sweeps is normally judged by observation of the increase in the volume of material returned to surface with the sweep.

In implementations, the sensors 110 can be utilized in a high density sweep analysis. In particular, annular pressures, recorded by the sensors 110 as the sweep is circulated, can be utilized to provide another method of analyzing the performance of a high density sweep. The high density sweep analysis can be used to create a prediction of the impact of circulating a high density sweep. The key to the high density sweep analysis is the ability to calculate the position of the high density sweep in the well during the circulation by utilizing the sensors 110. The high density sweep analysis can factor in any fluid displaced in the annulus by moving the drill string 104 as well as making use of the actual flow rates recorded at the drilling system 100 during the circulation. High density sweep analysis may not account for frictional pressure losses into account in the calculations, rather it calculates the anticipated change in annulus pressure measured at a fixed point on the drill string caused by the transit of the sweep through the wellbore 102. According to implementations, by attempting to understand how the sweep should impact the annular pressures in the wellbore during circulation, it is possible to derive information about the presence of solids in the well, their likely location and whether or not the hole is clean prior to tripping out of the well.

Figure 6:
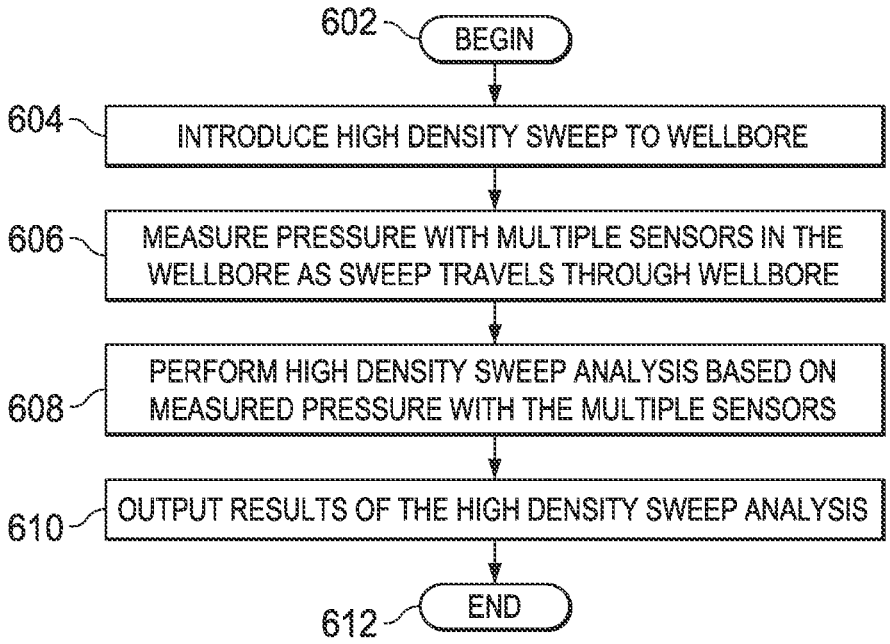
FIG. 6 is flow diagram that illustrates an example of a process for performing high density sweep analysis, according to various implementations.

FIG. 6 illustrates an example of a process for performing high density sweep analysis using multiple sensors, according to various implementations. While FIG. 6 illustrates various processes that can be performed by the computer system 112, any of the processes and stages of the processes can be performed by any component of the computer system 112 or the drilling system 100. Likewise, the illustrated stages of the processes are examples and any of the illustrated stages can be removed, additional stages can be added, and the order of the illustrated stages can be changed.

In 602, the process can begin. In 604, a high density sweep can be introduced into the wellbore 102. Any type of material and process can be utilized in the high density sweep.

In 606, the computer system 112 can measure the pressure with the sensors 110 in the wellbore 102 as the high density sweep travels through the wellbore 102. For example, the computer system 112 can communicate with the sensors 110 to obtain pressure measurement as the high density sweep travels through the wellbore 102.

In 608, the computer system 112 can perform the high density sweep analysis based on the measured pressure from the sensors 110. The computer system 112 can utilize algorithms to calculate the changes in hydrostatic pressure loading that would occur as the high density sweep circulated around the wellbore 102. The pressures calculated by the algorithms do not include the rest of the mud column, only the changes to the hydrostatic pressure that is experienced at a particular point on the drill string as a high density sweep is pumped around the well. These predicted changes can then be overlaid on the actual measured pressure data for comparison. In order to facilitate the process of overlaying the predictions on the actual data, real-time drill bit depth and flow rates during the circulation of the high density sweep can be used in the calculation process. Drill bit depth can be used to calculate sensor depths and annular flow rate variations caused by changes in the drilling fluid displaced by the moving drill string. The flow rate calculations can be used to calculate an accurate position of the high density sweep in the wellbore.

For example, positions at the top and bottom of the high density sweep can calculated at each time step by working out the volume of fluid pumped and volume of fluid displaced by the drill string 104. Once this is done, the distance, the top, and the bottom of the high density sweep, have moved in the annulus is calculated using their current positions and the annulus cross sectional area of the wellbore 102.

Once the location of the top and bottom of the high density sweep are known the vertical depth of each can be determined by correlating the calculated measured depth to the true vertical depth (TVD) using trajectory data. The vertical height between the top and bottom at the high density sweep can then used to calculate the pressure change. The pressure change is given by the equation:

$$\Delta P = \text{TVD} \times [(Rho_{sweep} - Rho_{mud}) \times 0.052]$$

where $\text{Rho}_{sweep}$ is the density of the high density sweep and $\text{Rho}_{mud}$ is the density of the drilling mud (in pounds per US gallon for example). The equation can produce a signature for the circulation of the high density sweep.

The signature can be overlaid on the actual pressure data to allow comparison of the predicted and actual data. The method can be further expanded by integrating it with the ECD fingerprint processes described above so that the curve is automatically adjusted to the correct vertical position on a chart of the actual pressure data and the predicted pressure data.

Because the calculation uses actual flow rate and drill bit depth data, once the prediction is fitted to the data measured by the sensors, the process can predict arrival times of the high density sweep on all sensors meaning that it can be used to judge whether or not an interval at the wellbore 102 between any 2 sensors is over or under gauge. If the high density sweep arrives late at a sensor then the high density sweep indicates that the volume of the annulus between the sensors is greater than planned—an equivalent diameter can then be calculated for the interval. The equivalent diameter can be calculated using the following equation:

$$\text{Equivalent Diameter} = \left(\frac{\left(\begin{array}{c}(\text{Actual Arrival Time} - \text{Predicted Arrival Time}) * \\ \text{Average flow rate between Actual and} \\ \text{predicted arrival times}\end{array}\right) * 4}{PI * \text{Distance between sensors}} + \text{Planned Hole Diameter}^2\right)^{0.5}$$

where Actual arrival time and predicted arrival time are in minutes, where average flow rate is in cubic feet per minute, where distance between sensors is in feet, where Planned hole diameter is in feet.

If there is a good fit between the shape of the predicted and actual curves, then either the high density sweep is not picking any material up (i.e. is ineffective) or there is no material to pick up. If the match between predicted and actual curves is poor then the points and magnitudes of depths can be used to determine quantity and location of settled material. By examining the fit on deep and shallow sensors, it is also possible to gauge whether or not material mobilized at depth is being transported to surface. If the fit between predicted and actual is poor downhole but good closer to the surface, the fit can imply that, while material is being mobilized deeper in the wellbore 102, the material never reaches the surface.

In 610, the computer system 112 can output the results of the high density sweep analysis. For example, the computer system 112 can output the results on the peripheral devices 162. The computer system 112 can output the results in numerical form. Likewise, the computer system 112 can output the results in graphical form. In 612, the process can end, repeat, or return to any stage.

Figure 7A:
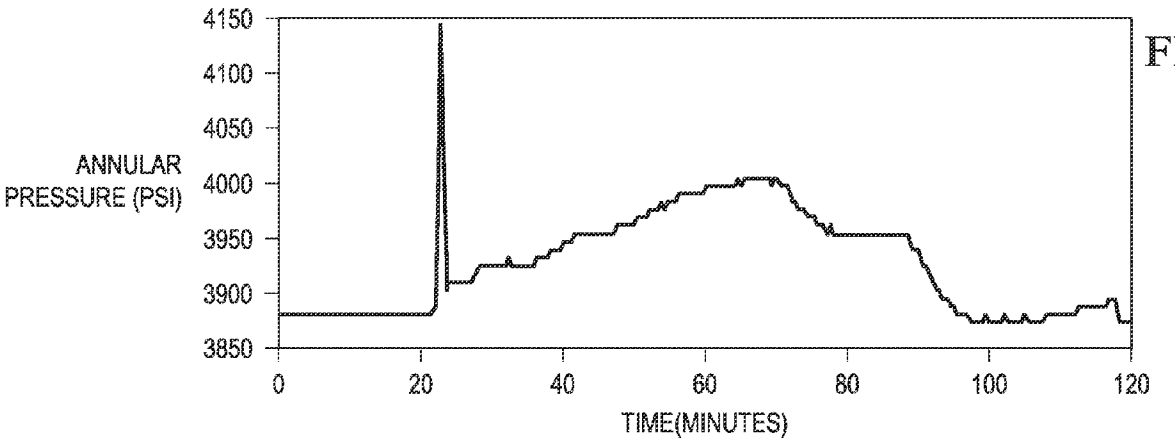
FIGS. 7A-7E are diagrams that illustrate examples of high density sweep analysis, according to various implementations.
Figure 7B:
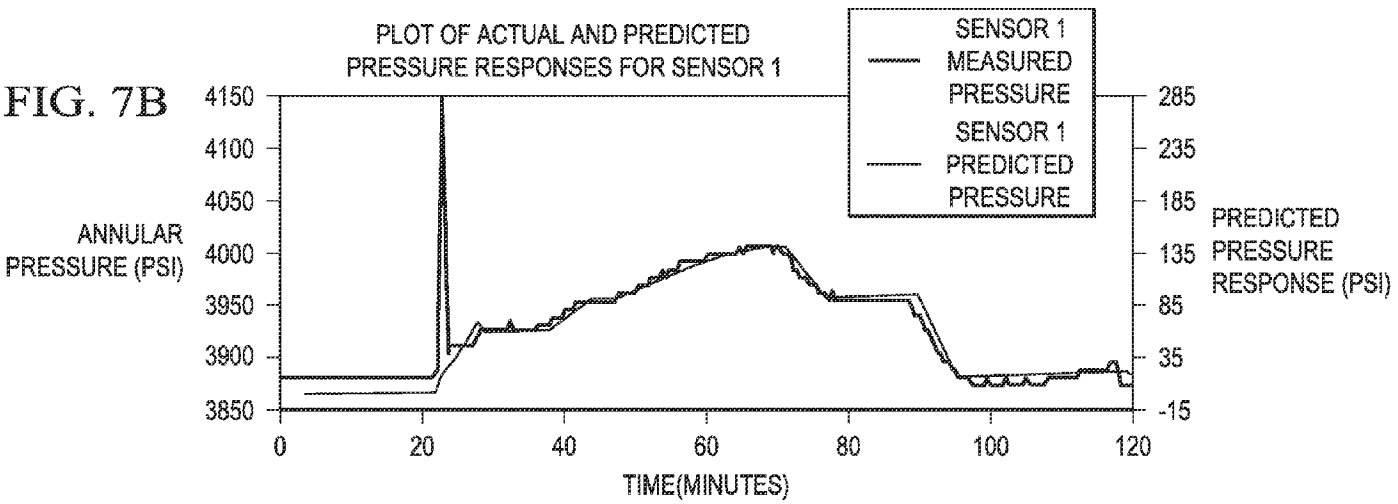

FIG. 7A shows an example of the annular pressure response to the circulation of a high density sweep as measured by multiple sensors. FIG. 7B shows the same high density sweep as before but this time includes the pressure prediction generated by the processes described above. It can be seen that the calculated pressure change matches the actual pressure change seen almost exactly (note the range of the scales for both the real time data and the prediction are the same). Because one of the sensors can be located in the BHA, the sensor can "see" pressure events throughout the entire of the mud column above the point of measurement. If there is a good correlation between the predicted curve and the actual curve for this sensor, it is an indication of a clean wellbore (or that the sweep is not effective in disturbing settled cuttings).

Figure 7C:
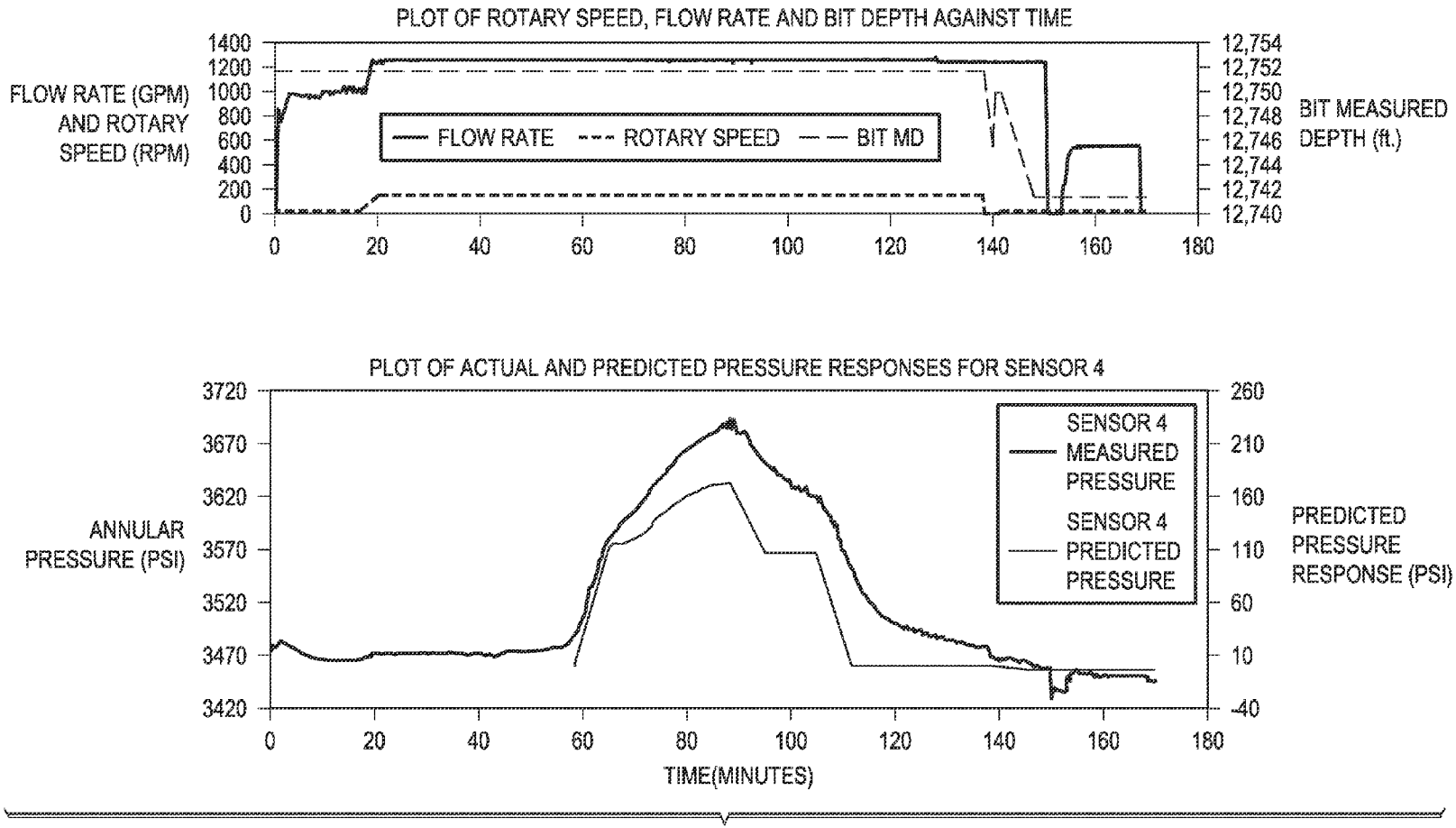

FIG. 7C shows another example of an annular pressure curve recorded during the circulation of a high density sweep along with the predicted pressure impact generated by the process described above. It is immediately noticeable that the fit is not as good as in the example illustrated in FIG. 7B. In this instance the pressure signature highlights the presence of solids in a tangent section of the wellbore. These are seen as an increase in the pressure during the circulation of the high density sweep pointing to solid material being picked up and transported by the high density sweep.

Figure 7D:
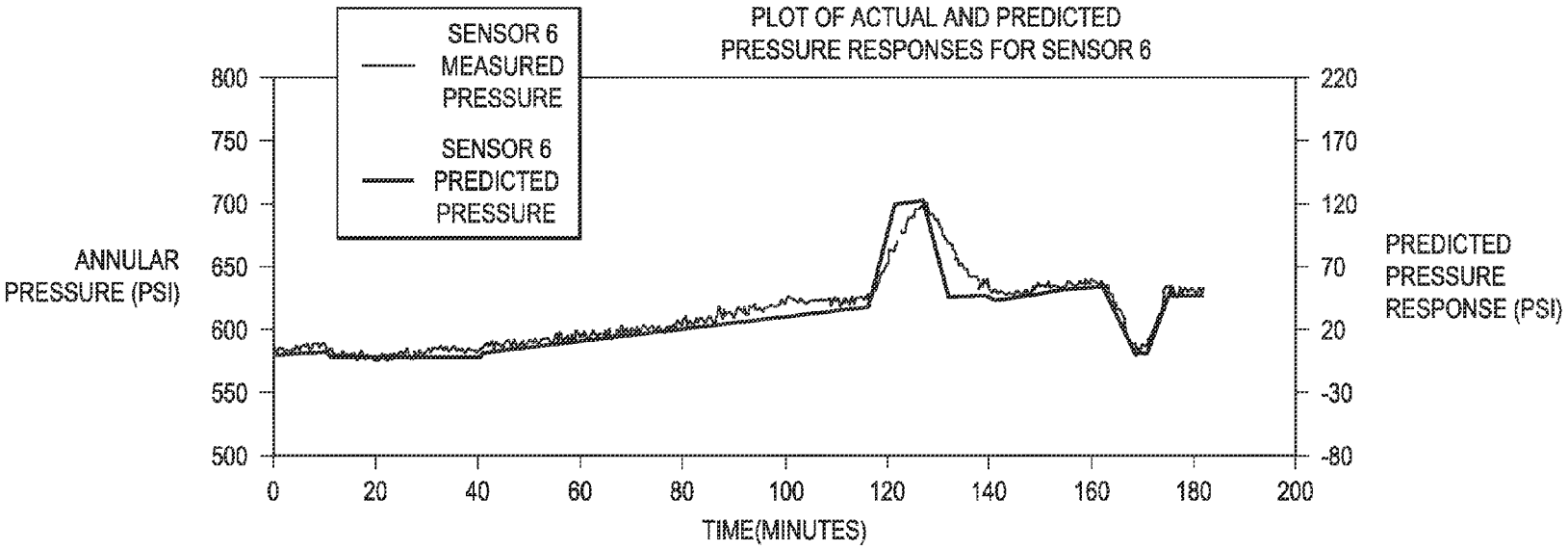
Figure 7E:
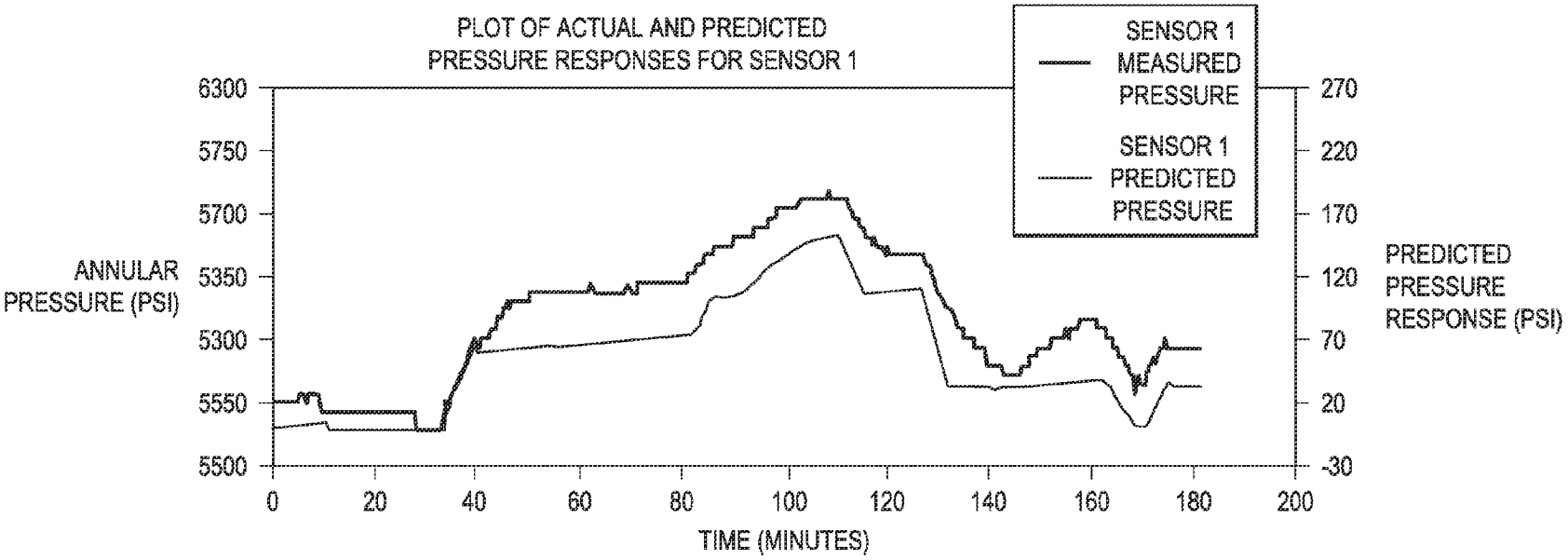

As in previous examples the main benefit of multiple measurements of annular pressure along the drill string 104 is the ability to monitor the changing pressure response caused by the high density sweep as it moves through the wellbore 102. In addition to determining whether the high density sweep is picking up additional material, the process can determine whether the material is subsequently transported back to surface. FIGS. 7D and 7E illustrate this. As with the previous example, predictions of the impact on hydrostatic pressure have been calculated and are displayed with the curves. In this particular example it can be seen that the response on the deeper sensor indicates a significant quantity of material is present in the wellbore and is being mobilized by the high density sweep and the effect of rotation. The shallower sensor, on the other hand, shows almost no indication of this additional material implying that it has not been transported out of the well but instead is still present at some point in the wellbore. In this example, the rounding of the pressure curve on the shallow sensor can be due to dilution of the sweep leading and trailing edges through mixing with the incumbent mud system.

Interval Solids Concentrations

The inclusion of multiple sensors, such as sensors 110, in the drill string 104 allows the wellbore 102 to be sectioned up into intervals bounded by any two sensors. In an open system, pressure can be an amalgamation of anything happening above the point of measurement. By utilizing this fact, it can be possible to isolate the pressure events occurring in a single section of the wellbore 102 bounded by any two sensors. This can be achieved by subtracting the pressure measured on the shallower sensor from that measured on the deeper. The subtraction leaves only the pressure caused by "events" in the interval between the two sensors. Part of the "events" can be the hydrostatic component which is relatively straightforward to factor out. The remainder can be made up of anything else that impacts the pressure measured by the sensor in the interval, including transported solids and frictional effects. Depending on the sensor 110 spacing, as well as wellbore 102 diameter, the frictional effects can be significantly smaller in magnitude than the effects of solids suspended in the flow. This process can be used in conjunction with time series data to provide information about the flow of solids both in and out of a given interval between 2 sensors and thus information about whether or not material is building up in a particular section of the wellbore 102.

Figure 8:
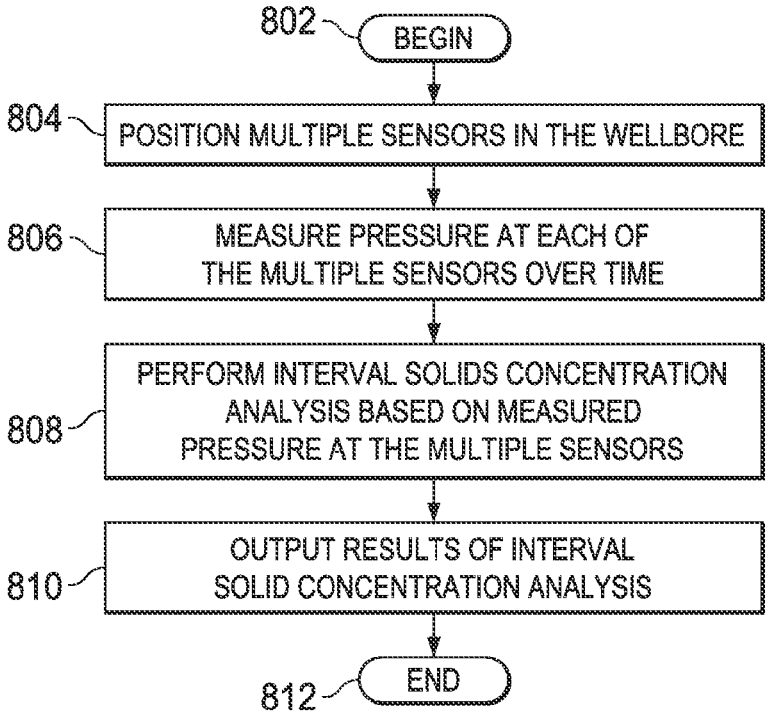
FIG. 8 is flow diagram that illustrates an example of a process for interval solids concentration analysis, according to various implementations.

FIG. 8 illustrates an example of a process for performing interval solid analysis, according to various implementations. While FIG. 8 illustrates various processes that can be performed by the computer system 112, any of the processes and stages of the processes can be performed by any component of the computer system 112 or the drilling system 100. Likewise, the illustrated stages of the processes are examples and any of the illustrated stages can be removed, additional stages can be added, and the order of the illustrated stages can be changed.

Figure 9:
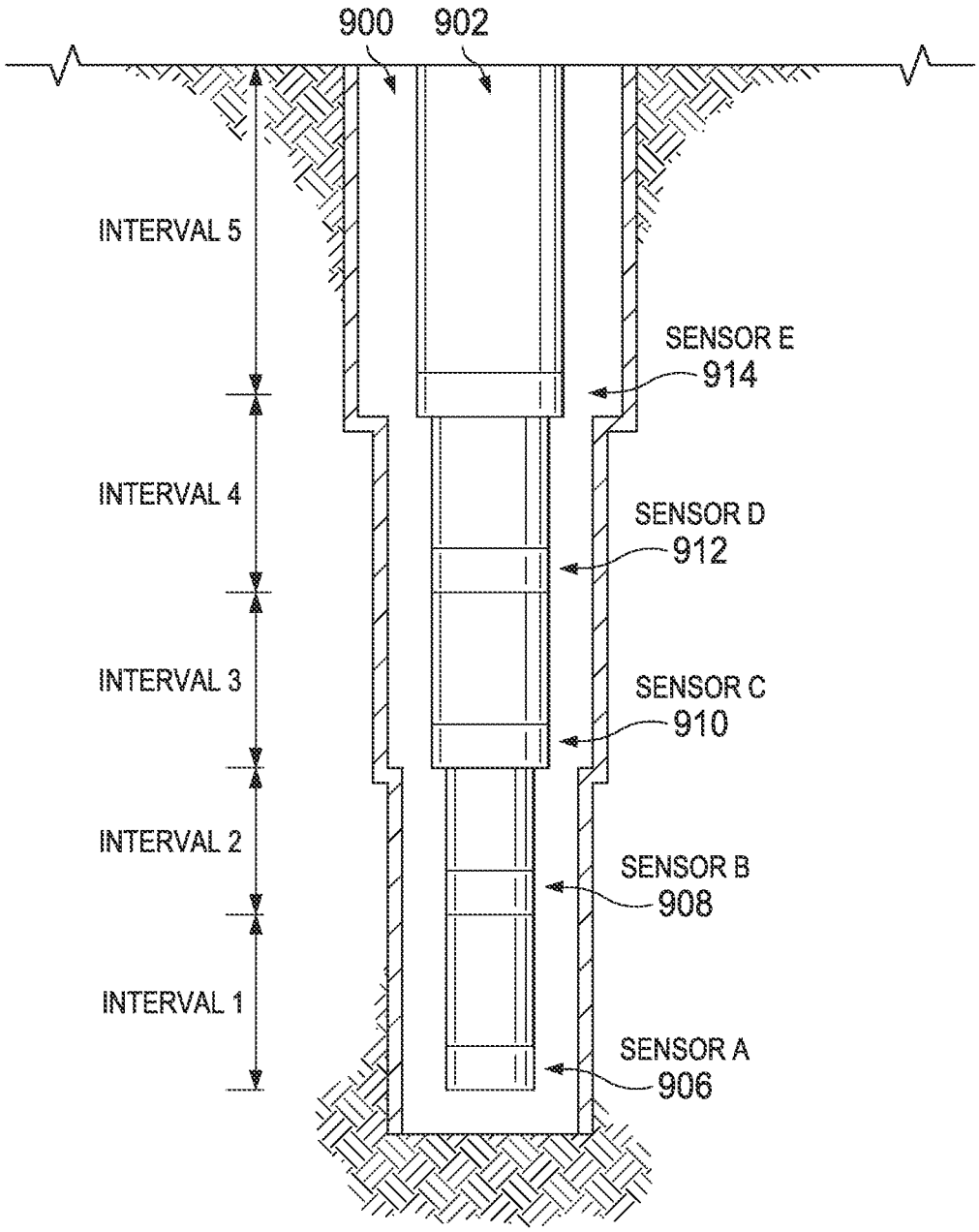
FIG. 9 is a generic diagram that illustrates an example of a wellbore in which interval solids concentration analysis can be performed, according to various implementations.

In 802, the process can begin. In 804, sensors can be positioned in the wellbore. For example, the sensor 110 can be positioned at varying intervals within the wellbore 102. FIG. 9 illustrates an example of a wellbore 900 with a drill string 902 that includes sensors at different intervals. The drill string includes a sensor a 906, a sensor b 908, a sensor c 910, a sensor d 912, and a sensor e 914. In this example, the sensor a 906, the sensor b 908, the sensor c 910, the sensor d 912, and the sensor e 914 can be pressure sensors. By positioning the sensor a 906, the sensor b 908, the sensor c 910, the sensor d 912, and the sensor e 914 along the drill string 902 it is possible to effectively break the wellbore 900 up into distinct intervals (1-5).

In 806, the computer system 112 can measure the pressure at each of the multiple sensors over time. For example, in the example of FIG. 9, the computer system 112 can measure the pressure at each of the sensor a 906, the sensor b 908, the sensor c 910, the sensor d 912, and the sensor e 914.

In 808, the computer system 112 can perform interval solids concentration analysis based on the measured pressure at each of the sensors. Pressure changes can then be isolated within intervals so it is possible to determine the origins of certain pressures during drilling. The origins of the pressures can be determined by isolating the pressures within the interval, e.g. removing the pressures seen by sensors above the interval of interest.

For example, in the example illustrated in FIG. 9, if the pressure measured on the sensor b 908 is subtracted from that measured on the sensor a 906, the pressure of events occurring between the sensor a 906 and the sensor b 908 (interval 1) can be determined. This can be given by the equation:

$$P_a - P_b = P_{ab}$$

where $P_a$ is the pressure measured by the sensor a 906 and $P_b$ is the pressure measured by the sensor b 908.

The $P_{ab}$ can be caused by several factors. The factors can include the hydrostatic pressure exerted by the fluid column between the sensor a 906 and the sensor b 908; any frictional pressure losses occurring between the sensor a 906 and the sensor b 908; anything else located between the sensor a 906 and the sensor b 908 that has an impact on annular pressure—for example suspended solids. The interval pressure can be determined for any combination of sensors to provide information about the interval by bound two sensors.

Once the interval pressure (e.g. $P_{ab}$) has been obtained, it can be used to extract information. Using predictions of static mud density the effect at the mud column can be factored out. This is done by calculating an average mud density between the pair of sensors. For example, if looking at the interval 1 between the sensor a 906 and the sensor b 908, the average mud density can be determined by the equation:

$$Avg\ \text{density} = \frac{\text{local mud weight at } a + \text{local mud weight } a\ \&\ b}{2}$$

This can then be multiplied by the vertical distance between the sensors to create a pressure exerted by the mud alone over that interval.

$$P_{mud} = \text{Avg density} \times (TVD_a - TVD_b) \times 0.052$$

where $P_{mud}$ in psi; Avg density in ppg; $TVD_a$ and $TVD_b$ in ft.

The pressure exerted by the mud $P_{mud}$ can then be subtracted from $P_{ab}$ to provide information about any pressure events not caused by the fluid column. Because the pressure measured by sensor b 908 has already been removed this allows us to see changing pressure events between the sensor a 906 and the sensor b 908 in time.

$P_{ab}$ can also be used to calculate an equivalent circulating density over the interval 1. This can be given by the equation $$ECD_{ab} = \frac{P_{ab}}{[(TVD_a - TVD_b) \times 0.052]}$$

where $ECD_{ab}$ in ppg; $P_{ab}$ in psi; $TVD_a$ and $TVD_b$ in ft. By monitoring these changes in interval ECD it is possible to determine changes in downhole conditions. The computer system 112 can perform the above calculations for any interval between two sensors.

In 812, the computer system 112 can output the results of the interval solids concentration analysis. For example, the computer system 112 can output the results one the peripheral devices 162. The computer system 112 can output the results in numerical form. Likewise, the computer system 112 can output the results in graphical form. In 812, the process can end, repeat, or return to any stage.

Certain implementations described above can be performed as a computer applications or programs. The computer program can exist in a variety of forms both active and inactive. For example, the computer program can exist as one or more software programs, software modules, or both that can be comprised of program instructions in source code, object code, executable code or other formats; firmware program(s); or hardware description language (HDL) files. Any of the above can be embodied on a computer readable medium, which include computer readable storage devices and media, and signals, in compressed or uncompressed form. Examples of computer readable storage devices and media include conventional computer system RAM (random access memory), ROM (read-only memory), EPROM (erasable, programmable ROM), EEPROM (electrically erasable, programmable ROM), and magnetic or optical disks or tapes. Examples of computer readable signals, whether modulated using a carrier or not, are signals that a computer system hosting or running the present teachings can be configured to access, including signals downloaded through the Internet or other networks. Concrete examples of the foregoing include distribution of executable software program(s) of the computer program on a CD-ROM or via Internet download. In a sense, the Internet itself, as an abstract entity, is a computer readable medium. The same is true of computer networks in general.

While the teachings have been described with reference to examples of the implementations thereof, those skilled in the art will be able to make various modifications to the described implementations without departing from the true spirit and scope. The terms and descriptions used herein are set forth by way of illustration only and are not meant as limitations. In particular, although the method has been described by examples, the steps of the method may be performed in a different order than illustrated or simultaneously. Furthermore, to the extent that the terms "including", "includes", "having", "has", "with", or variants thereof are used in either the detailed description and the claims, such terms are intended to be inclusive in a manner similar to the term "comprising." As used herein, the terms "one or more of" and "at least one of" with respect to a listing of items such as, for example, A and B, means A alone, B alone, or A and B. Further, unless specified otherwise, the term "set" should be interpreted as "one or more." Those skilled in the art will recognize that these and other variations are possible within the spirit and scope as defined in the following claims and their equivalents.

What is claimed is:

1. A method for determining conditions in a hydrocarbon well, the method comprising:

positioning a plurality of sensors in a wellbore, wherein the wellbore includes a drill string;

determining a pressure measurement for each of the plurality of sensors during operation of the drill string;

determining a pressure for an interval between a first sensor of the plurality of sensors and a second sensor of the plurality of sensors based on the pressure measurement determined for the first sensor and the pressure measurement determined for the second sensor;

determining a drilling fluid pressure contribution for the interval between the first sensor and the second sensor; and determining a non-drilling fluid pressure contribution for the interval based on the pressure for the interval and the drilling fluid pressure contribution.

2. The method of claim 1, wherein determining the drilling fluid pressure contribution for the interval comprises:

determining a drilling fluid density for the interval between the first sensor and the second sensor; and determining the drilling fluid pressure contribution based on the drilling fluid density.

3. The method of claim 1, the method further comprising:

determining an equivalent circulating density for the interval between the first sensor and the second sensor.

4. A system for determining conditions in a hydrocarbon well, the system comprising:

a plurality of sensors positioned in a wellbore, wherein the wellbore includes a drill string; and a computer system configured to perform a method comprising:

determining a pressure measurement for each of the plurality of sensors during operation of the drill string;

determining a pressure for an interval between a first sensor of the plurality of sensors and a second sensor of the plurality of sensors based on the pressure measurement determined for the first sensor and the pressure measurement determined for the second sensor;

determining a drilling fluid pressure contribution for the interval between the first sensor and the second sensor; and determining a non-drilling fluid pressure contribution for the interval based on the pressure for the interval and the drilling fluid pressure contribution.

5. The system of claim 4, wherein determining the drilling fluid pressure contribution for the interval comprises:

determining a drilling fluid density for the interval between the first sensor and the second sensor; and determining the drilling fluid pressure contribution based on the drilling fluid density.

6. The system of claim 4, the method further comprising:

determining an equivalent circulating density for the interval between the first sensor and the second sensor.

* * * * *